US006645130B2

(12) United States Patent
Webber

(10) Patent No.: US 6,645,130 B2
(45) **Date of Patent: *Nov. 11, 2003**

(54) FOLDABLE EXERCISE BENCH

(76) Inventor: Randall T. Webber, 100 Harbor Dr., #1404, San Diego, CA (US) 92101

( * ) Notice: Subject to any disclaimer, the term of this patent is extended or adjusted under 35 U.S.C. 154(b) by 324 days.

This patent is subject to a terminal disclaimer.

(21) Appl. No.: 09/761,878

(22) Filed: Jan. 17, 2001

(65) Prior Publication Data

US 2001/0018387 A1 Aug. 30, 2001

Related U.S. Application Data

(63) Continuation-in-part of application No. 09/366,511, filed on Aug. 3, 1999.

(51) Int. Cl.[7] ..... A63B 26/00
(52) U.S. Cl. ..... 482/142; 482/104; 482/133
(58) Field of Search ..... 482/104, 130, 482/142, 133; D21/690, 695; 5/532, 133, 142, 313.1; 297/354.1, 35.11–35.13, 377

(56) References Cited

U.S. PATENT DOCUMENTS

| | | | | | |
|---|---|---|---|---|---|
| 4,234,979 | A | * | 11/1980 | Bergerud | 5/133 |
| 4,369,966 | A | * | 1/1983 | Silberman et al. | 482/142 |
| 4,624,457 | A | * | 11/1986 | Silberman et al. | 482/142 |
| 4,634,127 | A | * | 1/1987 | Rockwell | 482/142 |
| 4,754,508 | A | * | 7/1988 | Nishiguchi | 5/90 |
| 4,826,157 | A | * | 5/1989 | Fitzpatrick | 482/142 |
| 4,861,025 | A | * | 8/1989 | Rockwell | 482/142 |
| 4,936,572 | A | * | 6/1990 | Desiderio | 482/142 |
| 4,974,839 | A | * | 12/1990 | Cantor | 482/142 |
| 5,056,779 | A | * | 10/1991 | Webb | 482/142 |
| 5,106,081 | A | * | 4/1992 | Webb | 482/142 |
| 5,322,489 | A | * | 6/1994 | Webb | 482/142 |
| 5,402,544 | A | * | 4/1995 | Crawford et al. | 297/354.13 |
| 5,437,589 | A | * | 8/1995 | Habing | 482/142 |
| D369,840 | S | * | 5/1996 | Clem | 482/142 |
| D384,116 | S | * | 9/1997 | Brefka | 482/142 |
| D390,287 | S | * | 2/1998 | Hsieh | 482/142 |
| 5,727,764 | A | * | 3/1998 | Angeles | 482/142 |
| 5,833,590 | A | * | 11/1998 | Chiu et al. | 482/142 |
| 5,882,283 | A | * | 3/1999 | Stevens | 482/142 |
| 5,921,897 | A | * | 7/1999 | Stevens | 482/142 |

OTHER PUBLICATIONS

Parabody 866 Strength Building System brochure, 1995.*
Treadmills Everyoun EY 86800F Jog & Fold brochure, 1997 Men's Journal company, L.P.*
Tuff Stuff brochure, TWC–35 Wild Combo Bench and TID–45 Multi–Purpose Bench, Mar. 1998.*
Tuff Stuff TWC–35 Assembly INstructions, Oct. 1997.*
New York Barbell 2100 Space Saver System Plus, Oct. 1999.
Hoist F160 and F162, Hoist Assembly Manuals, 1995.
Cybex Brochure 1996.

* cited by examiner

*Primary Examiner*—Nicholas D. Lucchesi
*Assistant Examiner*—L Amerson
(74) *Attorney, Agent, or Firm*—Brown, Martin, Haller & McClain LLP

(57) ABSTRACT

A foldable exercise bench is movable on a frame between a retracted, generally upright storage position and at least one deployed position for supporting a person during exercise. A support foot located adjacent one end of the bench is pivotally mounted for rotation between a first, storage position extending generally alongside the bench when the bench is in the storage position, and a second, support position in which the support foot extends forwardly at an angle to the bench and engages the floor to support the bench in the deployed position. A four-bar connecting linkage between the bench and frame automatically pivots the support foot from the second position to the first, storage position and locks it in the storage position when the bench is folded into the storage position.

15 Claims, 11 Drawing Sheets

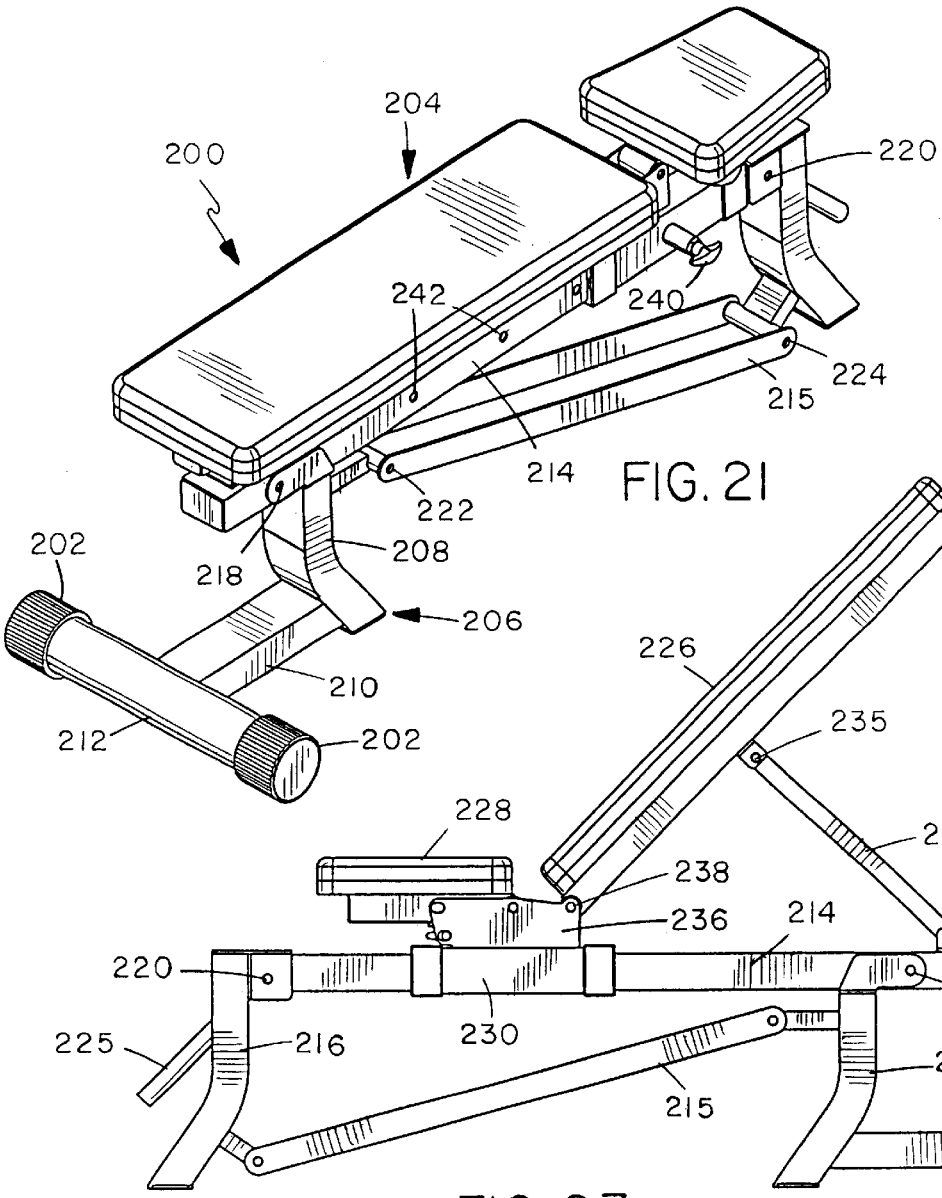
FIG. 21
FIG. 23
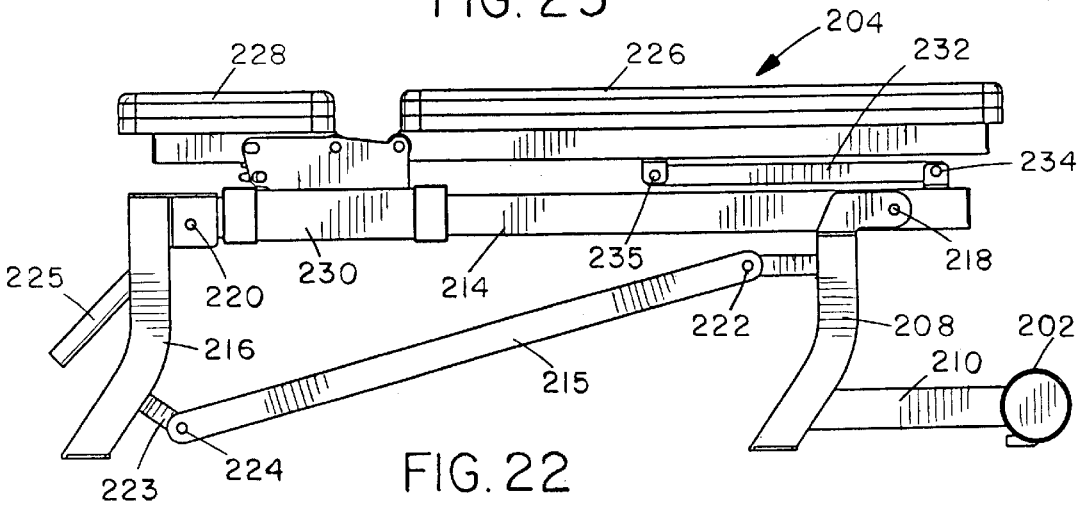
FIG. 22

FOLDABLE EXERCISE BENCH

This application is a Continuation-in-part of my application Ser. No. 09/366,511 filed Aug. 3, 1999.

BACKGROUND OF THE INVENTION

The present invention relates generally to exercise benches used for support when performing weightlifting or other resistance-type exercises, and is particularly concerned with a foldable exercise bench which can be folded up for storage.

Exercise equipment typically requires a large amount of floor space, regardless of whether it is in use or not. Thus, the advantages of a folding design for exercise benches and the like have been recognized for some time. Most prior art foldable exercise benches have disadvantages in that they require removal of lock pins before folding up for storage, and replacement of pins to lock the bench in the stored position. Such locking pins can fall out, be misplaced, or, if used improperly, may result in serious injury. One example of a foldable bench which must be locked in position via one or more locking pins is U.S. Pat. No. 5,882,283 of Stevens. In this case, a base member is pivotally connected to the frame and the two part bench is pivotally mounted on the base member. A stand is pivotally connected to the base member. A retractable device allows the bench and base member to be raised and lowered, and must be pinned in an extended position when the bench is moved into the raised, storage position.

Other folding benches are described in U.S. Pat. Nos. 4,634,127 and 4,861,025 of Rockwell, U.S. Pat. No. 4,826,157 of Fitzpatrick, and U.S. Pat. No. 4,369,966 of Silberman. In each case, the bench is movable into a vertical storage position, but one or more locking pins or devices must be removed in order to allow the bench to be pivoted into the storage position, and the bench must be locked in the storage position.

SUMMARY OF THE INVENTION

It is an object of the present invention to provide a new and improved foldable exercise bench.

According to the present invention, a foldable exercise bench is provided which comprises a stationary frame, an exercise bench pivotally mounted on the frame for movement between a retracted, generally upright storage position and at least one deployed position for supporting a person during exercise, the bench having opposite first and second ends, a support foot adjacent the first end of the bench pivotally mounted relative to the bench for rotation between a first, storage position extending generally alongside the bench when the bench is in the upright, storage position, and a second, support position in which the support foot extends at an angle to the bench and engages the floor to support the bench in the deployed position, and a pivotal linkage between the support foot and frame for automatically pivoting the support foot from the second position to the first, storage position when the bench is moved into the upright, storage position, the bench and support foot each being freely movable from the deployed and second positions to the storage and first positions, respectively, by lifting the bench.

Preferably, the pivotal linkage between the support foot and frame comprises a four-bar linkage having a primary connecting link with a front pivot pivotally connecting a front end of the link to the support foot and a rear pivot pivotally connecting a rear end of the link to the frame, and a secondary connecting link with a front pivot pivotally connecting a front end of the secondary link to the support foot at a location spaced below the front pivot of the primary connecting link, and a rear pivot pivotally connecting a rear end of the secondary link to the frame. The bench may be supported on top of the primary connecting link. In an exemplary embodiment, the bench is formed in two separate parts, comprising a back rest and a seat, and at least the back rest is pivotally mounted on the primary connecting link for movement between a plurality of different orientations relative to the seat. Both the back rest and seat may be mounted on a carriage which is slidably mounted on the primary connecting link for bench adjustment purposes. Alternatively, the bench may be stationary, formed in one part with one user supporting pad.

The four-bar linkage is designed such that the bench is self-locking in both the exercise ready and storage position. The four-bar linkage thus acts to automatically lock the support foot in a safe and secure position in both the storage position and the exercise-ready or deployed position of the bench. This avoids the need for any secondary locking device which must be unlocked prior to moving the bench and then re-locked when the bench reaches its new position. Instead, the user can fold or unfold the bench quickly and easily using only one hand.

In an exemplary embodiment of the invention, the front pivot of the secondary connecting link passes through an imaginary line or plane between the front pivot of the primary connecting link and the rear pivot of the secondary link as the bench is folded into the storage position. This provides improved locking ability, because the support foot must be lifted upward about its pivot connection to the primary link in order to unlock and unfold the bench. This reduces the risk of the bench unfolding accidentally if bumped, and allows the bench to be tipped or tilted without unfolding. In view of this, the support frame may be provided with wheels at a rear end, for engaging the floor to allow the bench to be transported when in the storage position, without fear of the bench unfolding. This is accomplished without requiring any pull-pins, through pins, or tension knobs, which was not possible with any prior art folding benches.

The bench may rotate through an angle of greater than 90° when moving between the deployed position and the storage position. In other words, the bench is folded past 90° (or perpendicular to the ground) in the storage position. This provides for optimum weight distribution, allowing the bench to stay in the generally upright, storage position without the use of a locking pin. Once in the storage position, the bench cannot easily be tipped over.

The support foot may have an attachment device for selective mounting of an accessory such as a leg exercise device or arm exercise device, or a support for the user when performing different exercises. Due to the stable storage position, any attached accessory does not have to be removed prior to storing the bench. In one example, the attachment device comprises an attachment tube secured to the foot at a predetermined orientation such that it extends substantially vertically when the bench is in the storage position. The support foot is arranged to project forwardly at an angle to the vertical when engaging the floor in the second position, for added stability and self-locking.

The support frame may include at least one upright member having a front side and a rear side, the bench extending forwardly from the front side of the upright member, and at least one horizontal, ground engaging member secured to the lower end of the upright member and extending a predetermined distance rearwardly from the upright member. This provides a stable base for resisting tipping of the bench when the first end is folded upwardly and rearwardly through an angle of greater than 90°. Wheels may be provided at the rear end of the horizontal member for transporting the bench in a folded, tipped orientation.

According to an exemplary embodiment of the invention, the bench is formed in two parts, comprising a backrest and a seat, and the backrest is pivotable relative to the seat into a plurality of different possible orientations depending on the exercise to be performed, including a flat orientation aligned with the seat for performing flat press exercises, a first inclined orientation relative to the seat for performing incline press exercises, and a second inclined position at nearly 90° to the seat for performing shoulder press exercises. In one embodiment, the support frame comprises two spaced upright members with a cross bar extending between the members to which the bench is attached via the pivot linkage. A second cross bar is adjustably mounted at any one of a series of at least three different heights on the upright members corresponding to the different backrest positions, and the backrest lies against the second cross bar in each of the different positions to provide the desired backrest angle.

According to another aspect of the present invention, an adjustable bench apparatus is provided which comprises a support frame, a support bar projecting in a generally forwards direction from the support frame, a bench adjustably mounted on the support bar, the bench having a seat and a back rest pivotally movable relative to the seat between a plurality of different orientations, and a carriage slidably mounted on the support bar for movement into any one of a plurality of different positions on the support bar, at least the back rest being secured to the carriage, whereby movement of the carriage along the bar rotates the back rest relative to the seat. In one embodiment of the invention, the support frame comprises a pair of spaced upright members and a cross bar extending between the upright members, and the back rest is supported against the cross bar. The seat and back rest are both mounted on the carriage, whereby movement of the carriage towards and away from the cross bar will cause the back rest to rotate upwardly and downwardly about the pivot. Preferably, a support wheel is rotatably mounted at the center of the cross bar, the wheel having a groove, and the back rest has a pivot support which engages the groove. This helps to reduce wear as the back rest is adjusted, and reduces side-to-side wobble in the back pad or back rest during use.

Preferably, the cross bar is adjustably mounted on the upright members for positioning at a plurality of different heights. The height of the cross bar will determine the basic height and angle of the back pad, while movement of the bench pad carriage will provide further angle adjustment. This arrangement may be provided in conjunction with either a folding or a non-folding bench.

The folding bench of this invention is much easier to move back and forth between storage and exercise-ready positions, requiring only one hand and no lock pins in any position. The improved back rest adjustment also has many advantages in reduced wear, better stability, and easier seat position adjustment.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which:

FIG. 21 is a perspective view of a foldable bench according to another embodiment of the invention;

FIG. 22 is a side view of the bench in a horizontal position;

FIG. 23 is a side view similar to FIG. 22 illustrating the back rest raised to an intermediate position;

DESCRIPTION OF THE PREFERRED EMBODIMENTS

FIGS. 1 to 12 illustrate an exercise bench apparatus 10 for performing free weight exercises according to a first embodiment of the present invention. The apparatus 10 basically comprises an upright frame 12 and a bench 14 adjustably secured to the frame via pivot linkage 16. The bench is freely movable between the deployed position of FIGS. 1 to 3 and the generally upright, storage position of FIG. 6 without requiring removal of any lock pins or the like, as explained in more detail below.

Figure 1:
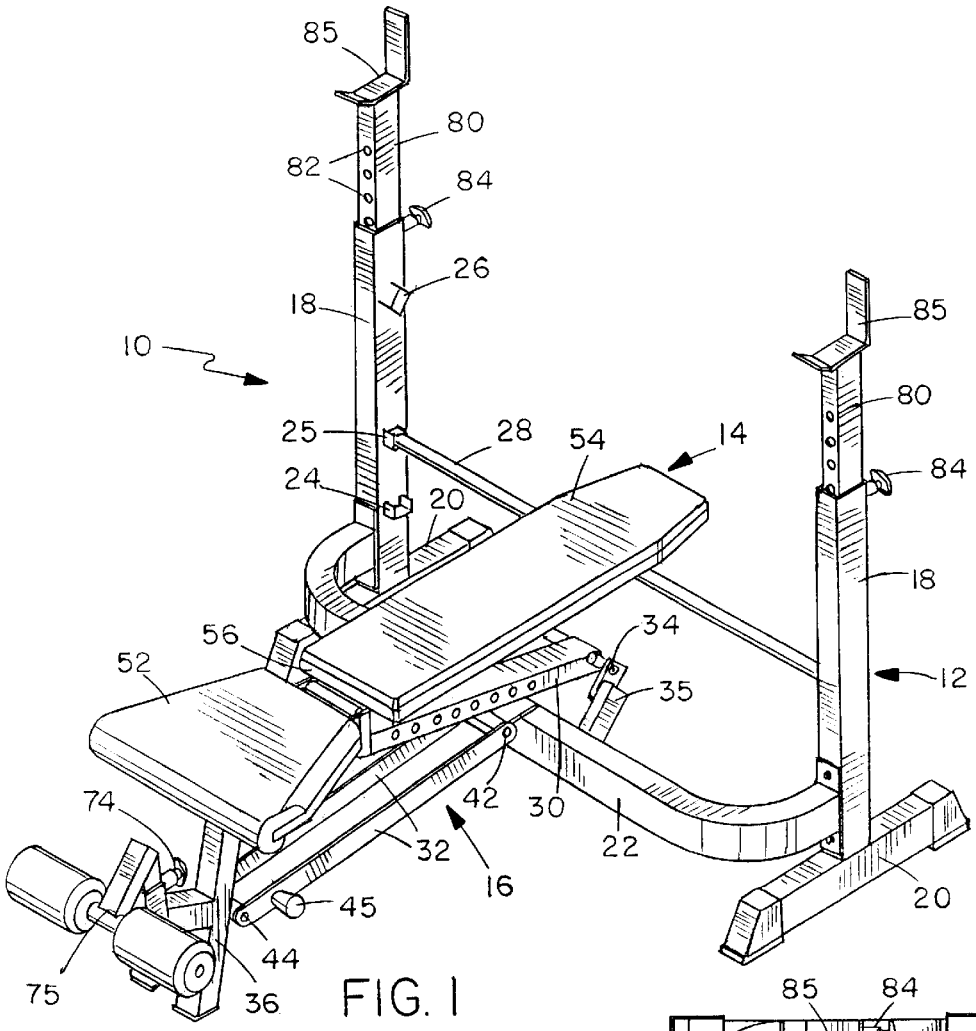
FIG. 1 is a perspective view of the foldable exercise bench according to a first embodiment of the invention.
Figure 6:
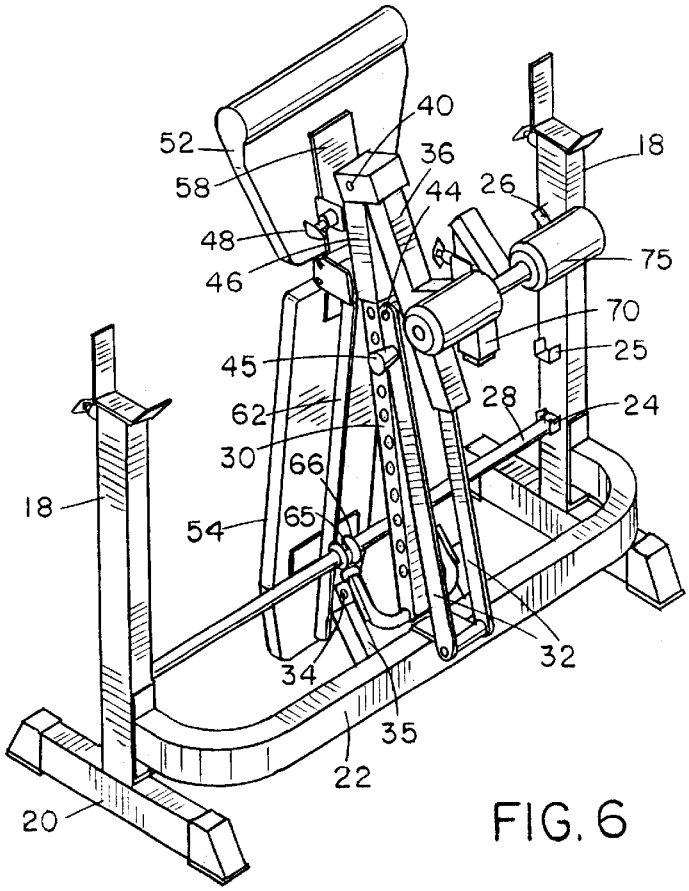
FIG. 6 is a perspective view showing the structure folded for storage.
Figure 7:
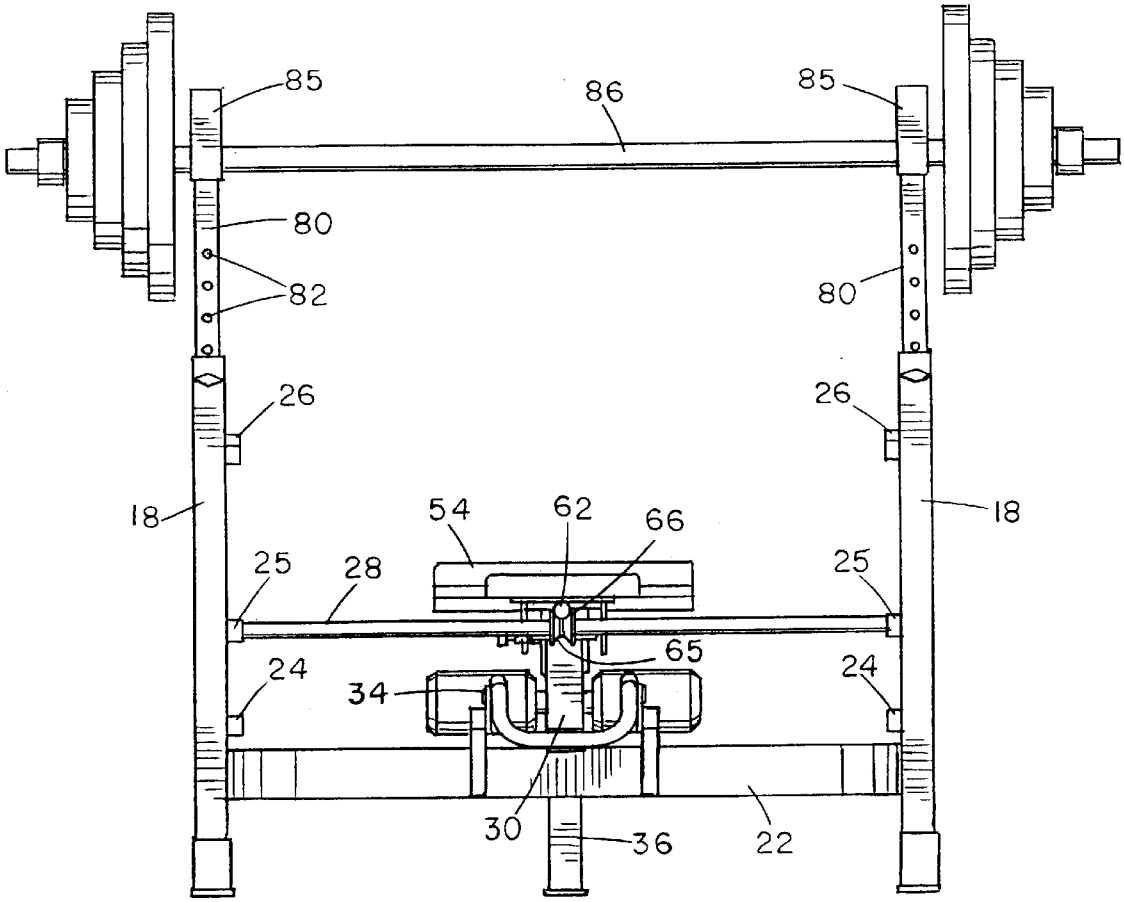
FIG. 7 is a rear view of the unit in the position of FIG. 3, and showing barbells on the vertical supports.
Figure 8:
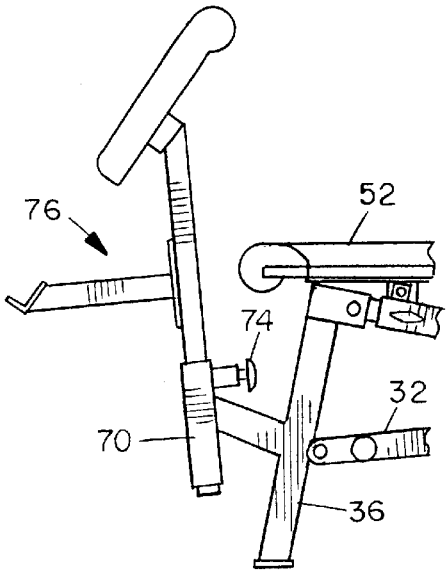
FIG. 8 is a partial side view showing an optional accessory attached to the support foot.

The upright frame 12 basically comprises a pair of spaced, upright struts 18 each having a cross bar or transverse base strut 20 at its lower end for stability, and a frame cross member 22 extending between the struts 18 at a location adjacent their lower ends, with arcuate end portions such that member 22 is offset forwardly from the plane defined by struts 20. A series of spaced pairs of aligned, U-shaped brackets 24, 25, 26, respectively, are provided on the opposing inner faces of upright struts 18, as best illustrated in FIGS. 1, 6 and 7. An adjustable cross member or rod 28 is selectively seated on any of the pairs of brackets so as to extend between the brackets. A greater number of brackets or indents may be provided along the length of each strut 18 to provide greater adjustability in the height of rod 28, if desired.

The pivot linkage 16 is a four bar linkage, comprising a primary link or support bar 30 and a secondary link 32. Primary link or bar 30 has one end pivotally mounted on the frame via a rear pivot pin 34 mounted between a pair of rigid flanges 35 extending from cross member 22 at a rearwardly inclined angle. A support foot 36 for the bench 14 is pivotally mounted at the forward end of primary link or support bar 30 via front pivot 40. Secondary link 32 is pivotally secured to cross member 22 at its rear end via rear pivot pin 42 spaced below and forwardly from rear pivot pin 34. The forward end of link 32 is pivotally secured to support foot 36 via front pivot pin 44 spaced below pivot pin 40. Secondary link 32 is provided with oppositely directed handles 45 at a location adjacent its forward end pivot 44. Secondary link 32 comprises a pair of parallel connecting links or bars, as best illustrated in FIGS. 1 and 6.

Figure 2:
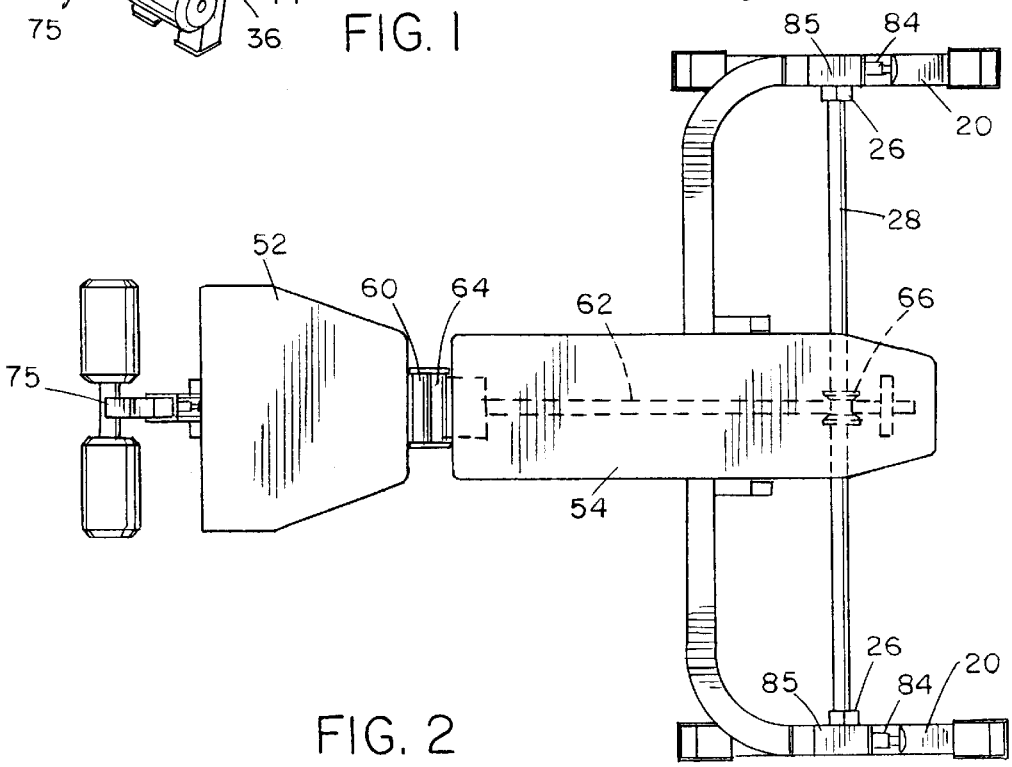
FIG. 2 is a top plan view of the unit.

The bench 14 is supported on primary link or support bar 30 via sliding carriage 46 which is slidably mounted on bar 30 and securable in any one of a plurality of selected positions along bar 30 via pop pin 48 engageable in any one of the openings 50 in bar 30. Bench 14 is formed in two separate parts, comprising a seat pad 52 and a back pad 54 having adjacent inner ends 55,56, respectively. Seat pad 52 is mounted on a base plate 58 which is pivotally mounted on carriage 46 via pivot pin 60 at location adjacent the inner end 55 of the seat pad. Similarly, back pad 54 is mounted on a support rod 62 which is also pivotally mounted on carriage 46 via pivot pin 64 adjacent the inner end 56 of the back pad. Thus, the seat pad and back pad are separately pivoted on the carriage 46 and can rotate independently from one another. Support rod 62 is designed to rest in a concave groove 65 on a support wheel 66 rotatably mounted at a central position on the adjustable cross bar 28, as best illustrated in FIGS. 2 and 7. The wheel 66 is rotatably mounted between collars on the shaft or cross bar 28 to retain it in its central position. Thus, as the carriage slides backwards or forwards along primary link tube 30, the back support rod 62 runs along groove 65, rotating wheel 66 and allowing smooth movement of the back pad 54. As an alternative to this arrangement, the sliding interengagement between wheel 66 and back pad 54 may be provided by a linear, concave groove running along the back of pad 54, in which the convex rim of wheel 66 slidably engages.

Figure 3:
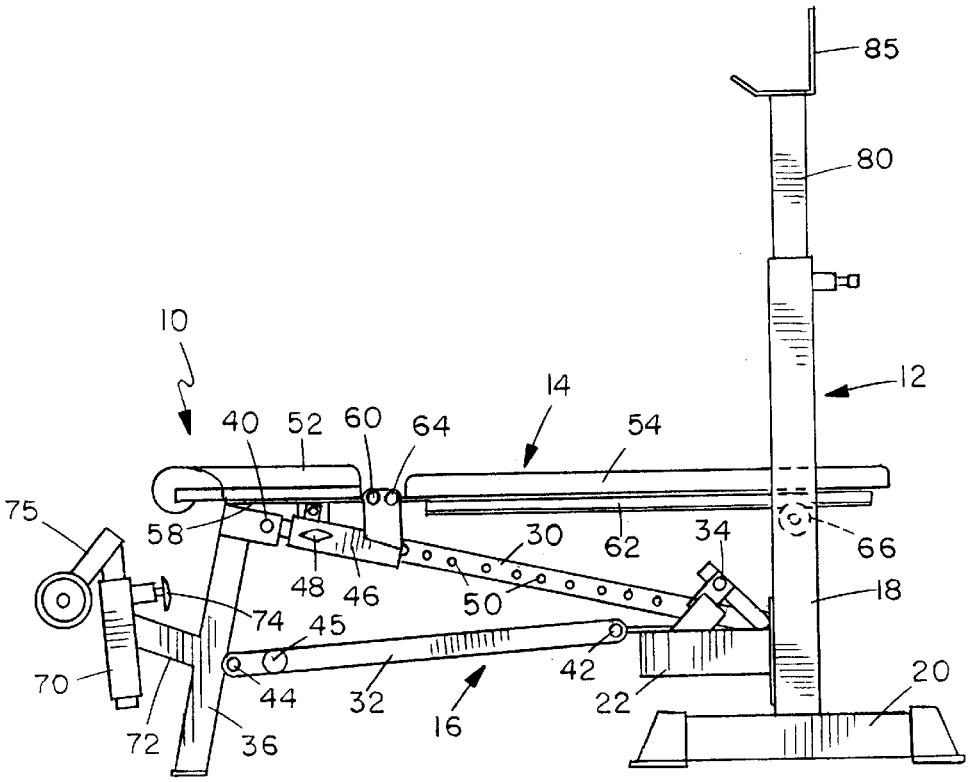
FIG. 3 is a side view with the bench in a horizontal position.
Figure 4:
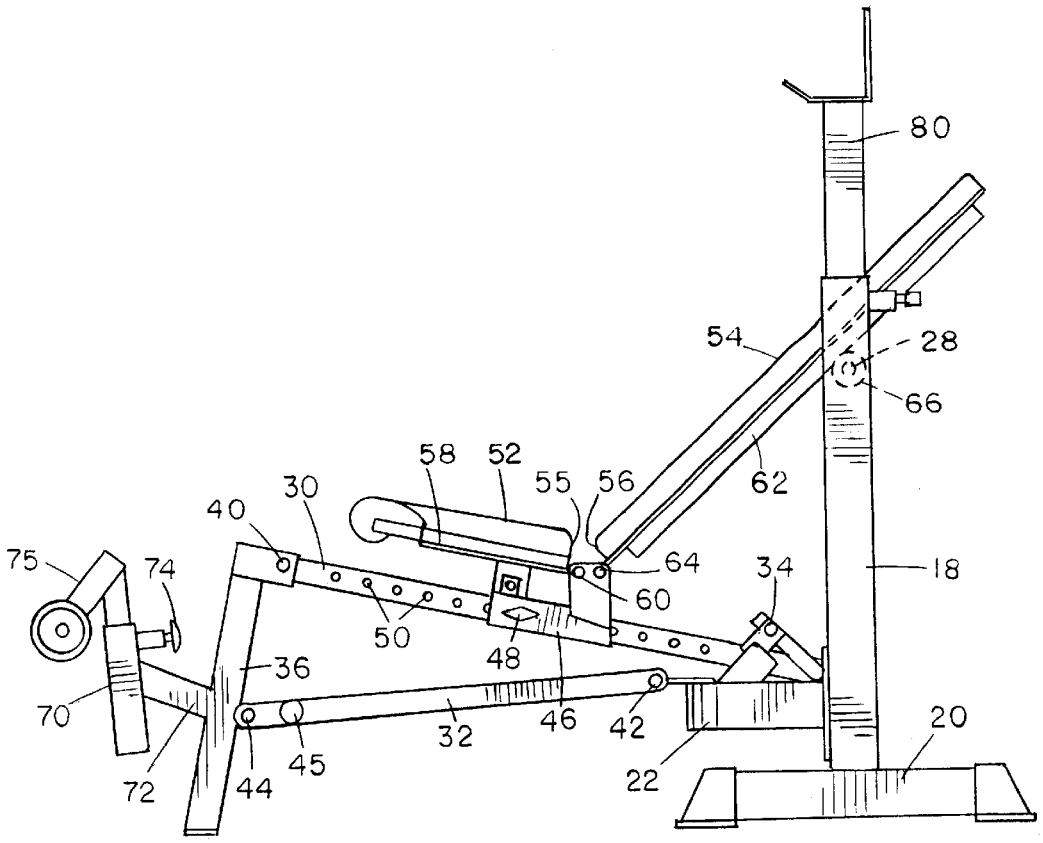
FIG. 4 is a side view with the back rest raised to an intermediate position.
Figure 5:
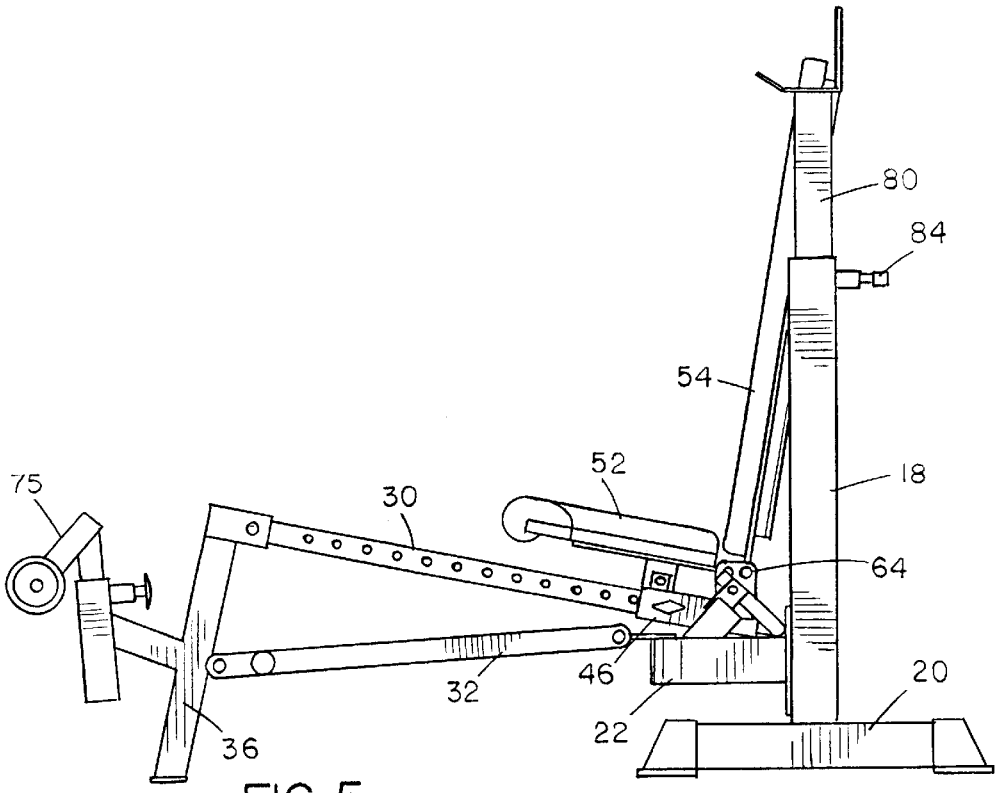
FIG. 5 is a side view with the back rest fully raised.
Figure 9:
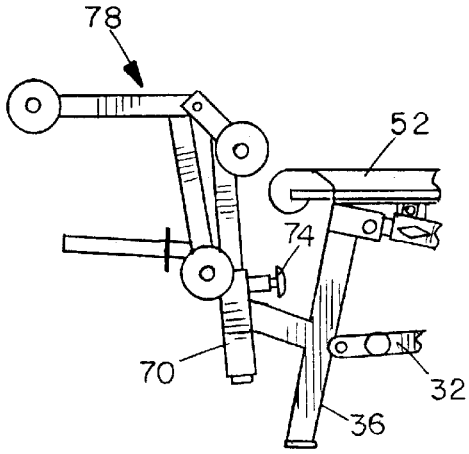
FIG. 9 is a partial side view showing a different accessory attached to the support foot.

As best illustrated in FIGS. 3 to 5, an accessory attachment tube 70 is secured to support foot 36 via connecting bar 72 which projects outwardly from the front face of foot 36. The arrangement is such that, when the support foot is in its extended, operative position engaging the ground to support the front end of the bench 14, it will be inclined forwardly from pivot 40 at a non-normal angle to the ground surface. The attachment tube 70 is oriented at an angle relative to the support foot 36 so that the tube 70 extends vertically when the foot is in the operative, ground engaging position of FIGS. 1 and 3 to 5. Attachment tube 70 may be used to attach any desired accessory to the foot, via a releasable pop pin 74 on the tube which engages an opening in a mating telescopic member on the accessory. Thus, for example, adjustable leg rollers 75 may be attached to tube 70 as illustrated in FIGS. 1 to 6. Alternatively, a preacher curl attachment 76 may be inserted in tube 70, as in FIG. 8. FIG. 9 illustrates another option in which a leg extension/curl attachment 78 is attached to tube 70. Other accessories may also be attached to tube 70, as desired.

Each of the uprights 18 is a tubular member with an open upper end, and an upper strut 80 is telescopically mounted in the open upper end of each of the uprights 18. Each of the struts 80 has a series of spaced openings 82 (see FIG. 1), and a releasable pop pin 84 extends through an opening adjacent the upper end of each upright 18 to releasably engage a selected one of the openings 82 to secure the strut 80 at a selected height. Each strut 80 has a bracket 85 at its upper end. A barbell 86 may be placed across brackets 85 when not in use, as illustrated in FIG. 7, and used in performing press exercises by individuals lying on bench 14 in the flat press position of FIGS. 1 to 3, for example.

Figure 10:
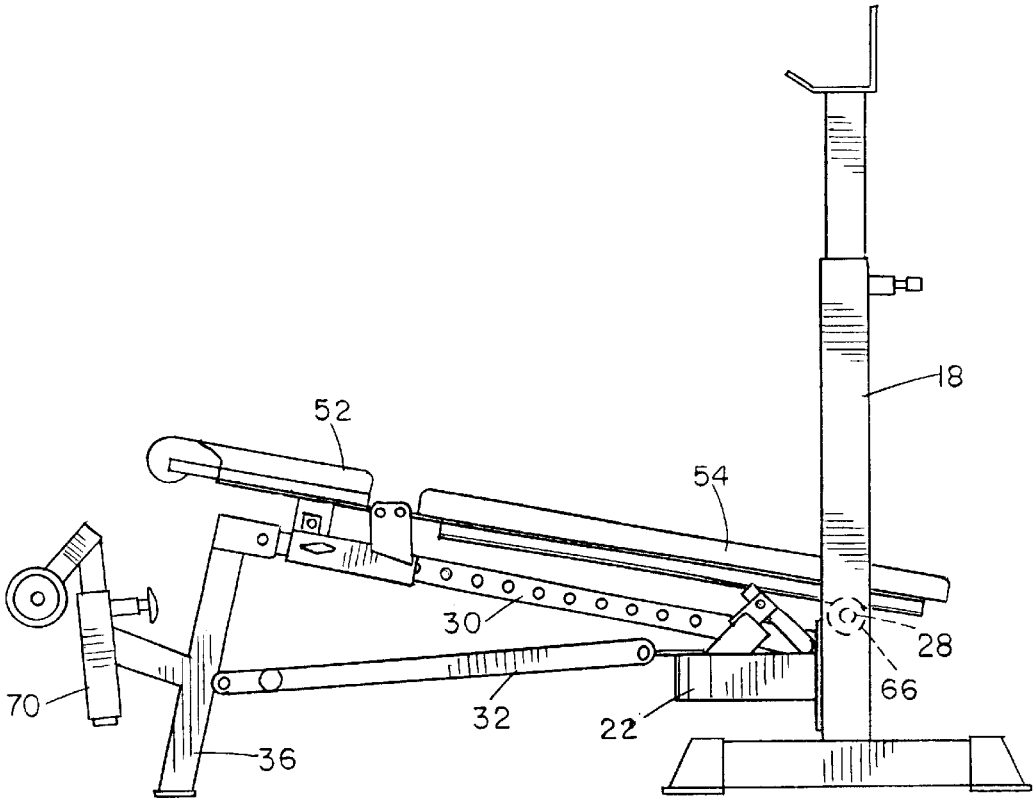
FIG. 10 is a side view with the bench in a declined position.
Figure 11:
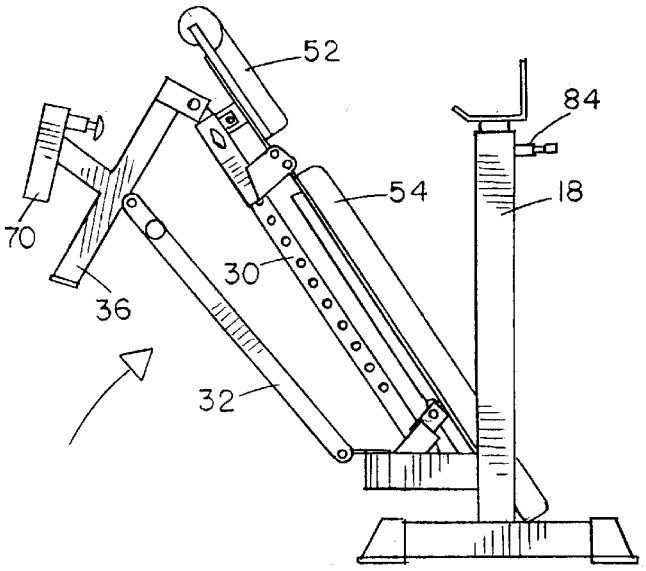
FIG. 11 is a side view showing the bench partially folded.
Figure 12:
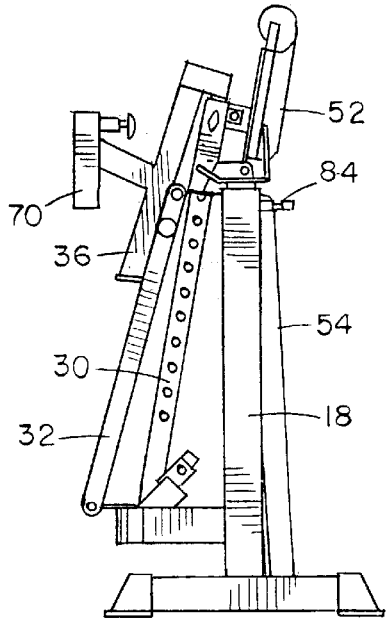
FIG. 12 is a side view showing the bench fully folded.

The folding exercise bench of FIGS. 1 to 12 requires no secondary adjustment to change from an exercise ready position as illustrated in FIGS. 1 to 3 and 10 and a storage position as illustrated in FIGS. 6 and 12. The relationship between the pivoting support foot 36 and the secondary connecting links 32 is such that the secondary links 32 wedge the support foot against the primary link tube 30 in a stable and secure position when deployed in the exercise ready position of FIGS. 1 to 3. When the bench 14 is to be moved into a storage position so that it takes up less floor space when not in use, the bench is simply lifted up at its forward end, rotating the primary link member about the first pivot 34 on the frame in the direction of the arrow in FIG. 11. At the same time, the support foot 36 is raised, and, due to the secondary connecting link, will pivot inwardly in an anti-clockwise direction about the pivot pin 40. This rotation continues until the bench 14 reaches the upright storage position of FIG. 6, at which point the foot 36 is folded inwardly by secondary link 32 to run alongside the primary link or support tube 30.

The amount that the support foot 36 pivots is controlled by the relative lengths of the two pivotal links 30,32 and the relationship between their attachment points to the frame and to the foot 36. As best illustrated in FIGS. 3 to 5, the links 30,32 are of different lengths, and their attachment points to the frame are offset such that the foot 36 is forced to pivot inwardly and fold up tight against the primary link or support tube 30 when the bench is moved into the storage position.

FIGS. 10 to 12 illustrate sequential positions of the bench as it is folded from a deployed or exercise position into a storage position. In FIG. 10, the bench is shown in an exercise ready, decline press position, although it may be folded up from the flat press position of FIGS. 1 to 3 as well. In the decline press position, cross rod 28 is supported on the lowermost brackets 24 on uprights 18, resulting in the bench inclining downwardly as shown. A barbell 86 on the upright struts does not have to be removed before the bench is stored if the cross rod 28 is in either of the two lowermost positions on bracket 24 or 25, and the upright struts are in either their lowermost or uppermost positions, in view of the position of the pivot points spaced in front of the plane of the uprights 18. In the lowest setting, the bar fits into the space between the two seat pads. In the highest setting, the pad will pass under the bar. If the pivot points were spaced further from the upright 18, then the bench would clear the barbell 86 regardless of the positioning of the uprights. However, this would increase the overall length of the bench and thus the installation space required.

FIG. 11 illustrates the bench in an intermediate position during folding, as the linkage 32 starts to fold in support foot 36. FIG. 12 illustrates the stable, automatically locked storage position of the bench. The bench rotates beyond the vertical position so that it is inclined slightly rearwardly when the storage position is reached. The attachment tube 70 on the support foot is designed to be oriented vertically when the bench and foot are both in the folded, storage position of FIG. 12. Thus, any attachments to tube 70 will also be positioned in a substantially vertical, stable orientation when the folded bench is in the storage position, as also illustrated in FIG. 6.

Because the bench is folded past 90° (perpendicular) into the storage position, it will stay in the storage position without requiring any lock pins or other locking devices to hold it in place. The majority of the weight of the bench, i.e. the pads, connecting links, and support foot, is folded past the perpendicular or vertical position, so that the folded bench will be stable and will not tend to fall forwards. At the same time, the four-bar linkage acts as a stop to keep the bench from folding any further back. This provides for optimum weight distribution. Once in the storage position, because of the stable base, the entire bench assembly, with or without attachments, will not easily tip over. The support foot is also automatically held in the folded, stored position of FIGS. 6 and 12 by the secondary links. The bench is virtually locked in the stored position and the support foot must be folded upwardly and outwardly before the bench can be lowered into an exercise ready position. Handles 45 may be used for this purpose.

By pivoting the primary link tube 30 at a precise location spaced above the floor level and in front of the plane defined by the frame uprights 18, the bench can be folded into the storage position without needing to first remove the barbell. When a user is finished with their workout, they simply grab a handle 45, and lift and pivot the front end of the bench as illustrated in FIGS. 6, 11 and 12. This moves the bench apparatus into a very compact, stable storage position where it does not take up any unnecessary floor space. The bench is self-locking in both the storage and exercise ready position.

The bench is readily adjustable between a number of different possible exercise ready positions by adjustment of the height of cross member 28 and the position of carriage 46 on primary link 30. FIGS. 1 to 3 illustrates a flat press position in which the seat pad 52 and back pad 54 are aligned horizontally with carriage 46 at a position adjacent the left hand end of primary link or support tube 30 and the support rod 62 of back pad 54 resting on cross member 28 with the ends of the cross member supported on the second pair of brackets 25 on uprights 18. The angle of the bench can be readily adjusted to a decline press position simply by moving the cross member down to rest on the lowermost brackets 24. The back pad will then be inclined downwardly, along with seat pad 52, to a flat, decline press orientation, as illustrated in FIG. 10.

The bench may be readily moved from the flat press position of FIG. 3 to the incline press position of FIG. 4 simply by moving the cross member 28 to the uppermost pair of brackets 26, and moving carriage 46 along link or tube 30 towards the uprights 18 or rear end of the bench apparatus, until the desired angle of back pad 54 relative to seat pad 52 is reached. At this point, the carriage is locked in position via pop pin 48. This adjustment is made easier by the fact that the support rod 62 on the back pad runs along groove 65 in the wheel 66, which rotates about the cross member 28 to accommodate the adjustment. Thus, no wear is incurred by sliding of the back pad back and forth across cross member 28. The bench is moved from the incline press position of FIG. 4 to the shoulder press position of FIG. 5 simply by unlocking carriage 46, and sliding it further along tube 30 until the back pad reaches the nearly vertical orientation illustrated, at which point the carriage 46 is again locked in position. Thus, the bench is adjustable between a wide variety of different possible exercise ready positions, as well as being readily movable into a storage position when not in use.

In this arrangement, the back pad and seat pad are pivoted to the carriage 46 at two separate locations 60, 64. This has the advantage that the pivot attachments can be adjusted and tightened independently. Because of this, the right amount of pressure can be applied to the seat and back pivot connections to provide both smooth pivot motion and reduced play/wobble in the pads. The pivot support rod 62 of the back pad provides several advantages. First, in conjunction with the rotating wheel 66 it engages on cross member 28, it reduces side-to-side wobble of the back pad during use. Secondly, the arrangement provides multiple adjustment positions for performing various exercises, and increases the ease of adjustment when the bench pad carriage is moved. Thirdly, it increases the strength and stability of the back pad in all positions when lifting of heavy weights is involved. The support rod also prevents wear to both the back pad upholstery and the adjustable cross member surface, which is a problem when the back pad slides directly over a cross piece.

FIGS. 13 to 20 illustrate a foldable bench apparatus 90 according to a second embodiment of the invention. This embodiment is similar to the first embodiment, but eliminates the spaced uprights 18. Additionally, unlike the previous embodiment, the seat pad and back pad are not separately pivoted to a moving carriage in this embodiment.

The apparatus 90 basically comprises a bench assembly 92 pivoted to a stationary frame. The stationary frame has a generally upright strut 94, a base support strut 95 extending horizontally away from strut 94 at the lower end of the strut, and a cross bar 96 with feet 98 extending across the end of strut 95 to provide a stable base for the apparatus. The bench assembly is pivotally mounted at the upper end of upright strut 94. The bench assembly 92 comprises a bench support bar or tube 100 on which separate first and second pads 102,104 are mounted. The bench support tube 100 is pivoted to the upper end of upright strut 94 via pivot pin 105.

Figure 15:
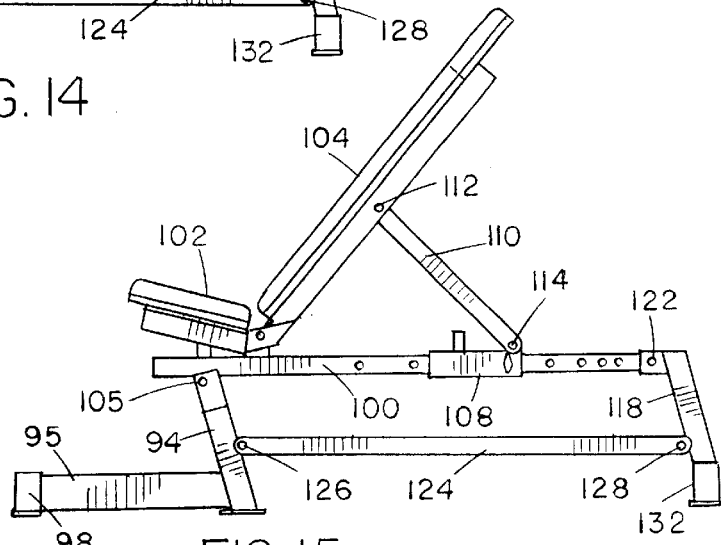
FIG. 15 is a similar view with the back rest raised.

The two pads are each pivotally secured to the bench support tube via pivot 106 at their adjacent inner ends. The second pad 104, which acts as a back pad in some orientations of the bench, is also connected to a carriage 108 which is slidably mounted on support tube 100. The pad 104 is connected to the carriage 108 via pivotal link 110, which is pivoted to the back pad via pivot pin 112 and to the carriage 108 via pivot pin 114, as best illustrated in FIG. 15. The carriage may be releasably locked in any selected position on the support tube 100 via pop lock pin 115 extending into any one of a series of spaced openings 116 in the tube 100. Sliding of the carriage 108 along tube 100 will raise and lower the back pad into any one of a plurality of different orientations relative to seat pad 102.

A support foot 118 is pivotally mounted on the upright strut of the stationary frame via a four bar linkage, as in the previous embodiment, and is located adjacent the forward end 120 of the second pad 104. Support tube 100 of the bench is the primary link of the four bar linkage, and support foot 118 for the bench is pivotally mounted at the forward end of primary link or support tube 100 via pivot 122. A secondary link 124 of the four bar linkage is pivotally secured to upright strut 94 at its rear end via pivot pin 126 spaced below and forwardly from pivot pin 105. The forward end of link 124 is pivotally secured to support foot 118 via pivot pin 128 spaced below pivot pin 122. Secondary link 124 may be provided with oppositely directed handles (not illustrated) at a location adjacent its forward end pivot, as in the previous embodiment, for ease in lifting the bench between the deployed and storage positions. Secondary link 124 comprises a pair of parallel connecting links or bars, as best illustrated in FIG. 13.

Support foot 118 has a base cross bar 130 at its lower end, with feet 132 at opposite ends of cross bar 130 for added stability. As in the previous embodiment, the support foot 118 is designed to be inclined forwardly from the forward ends of support tube 100 and pad 104 in the deployed position of FIGS. 13 to 15. The relationship between the support foot 118 and the primary and secondary connecting links 100, 124 of the four bar linkage is such that the secondary links 124 wedge the support foot against the floor and the end of the primary link tube 100 in the deployed position. The support foot therefore supports the bench in a stable and secure position.

Figure 13:
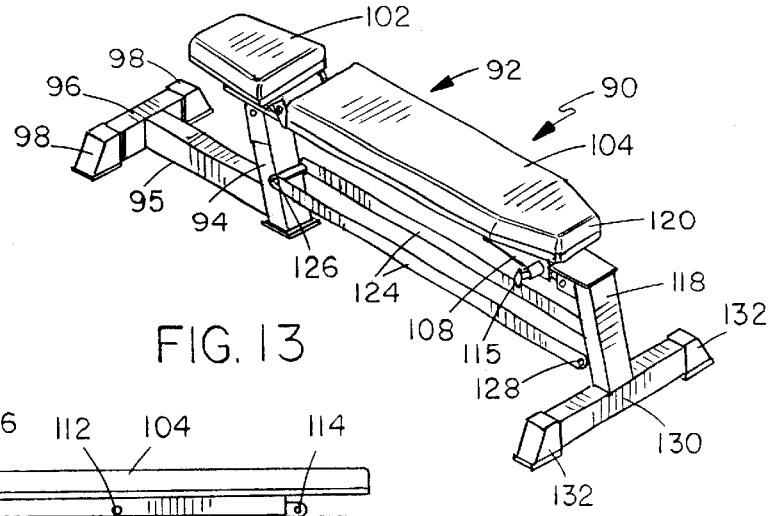
FIG. 13 is a perspective view of a bench unit according to another embodiment of the invention.
Figure 14:
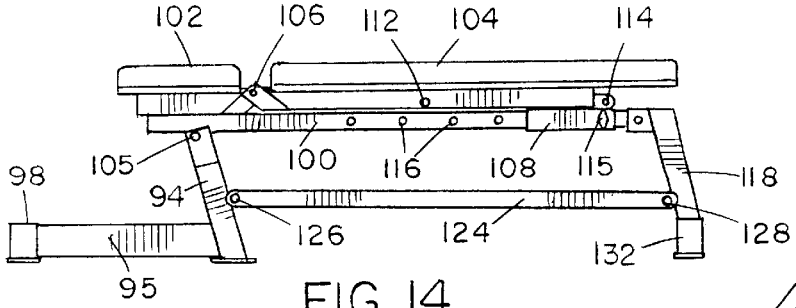
FIG. 14 is a side view of the unit of FIG. 13 with the bench in a horizontal position.

The two pad exercise bench may be readily adjusted between a variety of different, exercise ready positions, as illustrated in FIGS. 13 to 15 and 18 to 20. FIGS. 13 and 14 illustrate a flat press position of the bench, in which the pads 102, 104 are both oriented horizontally and a user can lie flat across the bench to lift weights. The pivot link 110 is folded flat under pad 104 and the carriage 108 is located at the right hand end of the support tube 100 as viewed in FIGS. 13 and 14. If a user wishes to move the bench into an incline press position, the carriage lock pin 115 is released, and the carriage is moved rearwardly along tube 100, simultaneously tilting pivot link 110 upwardly and forcing the second pad 104 to pivot upwardly about pivot pin 106 until it is tilted upwardly relative to the first pad 102. The second pad 104 is locked in position when a desired orientation relative to the first pad 102 is reached. FIG. 15 illustrates one possible incline press position. Further movement of carriage 108 to the left as viewed in FIG. 15 will result in a more upright orientation suitable for shoulder press exercises. In both the incline press and shoulder press positions, pad 104 acts as a back pad while pad 102 acts as a seat pad.

Figure 17:
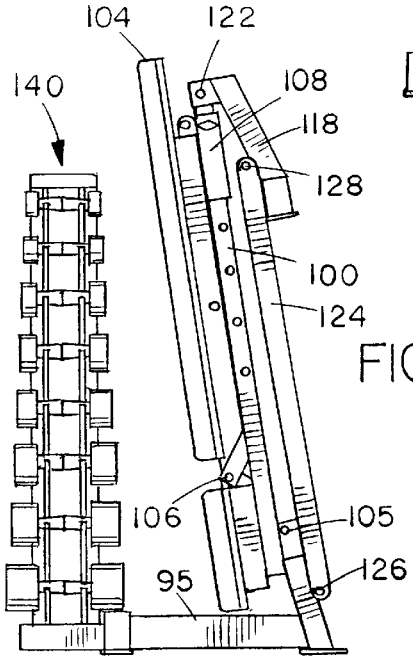
FIG. 17 shows the unit fully folded.
Figure 16:
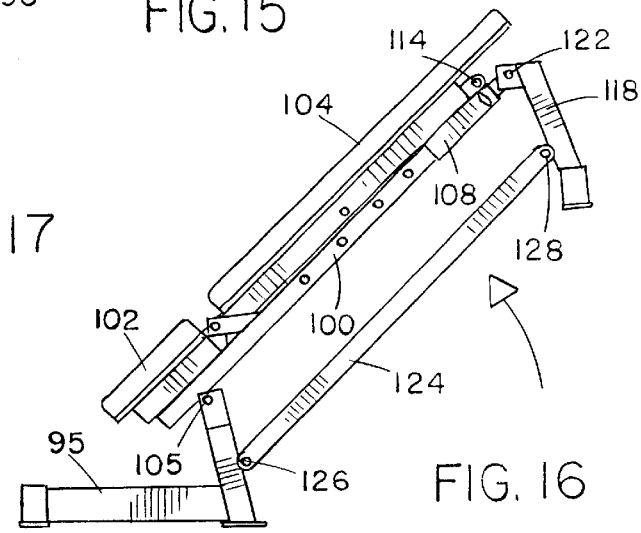
FIG. 16 shows the unit partially folded.

The exercise bench may be readily folded from the deployed, exercise position of FIG. 14 into a generally upright, storage position as illustrated in FIG. 17. The user simply grips either the end of pad 104 or a handle (not illustrated) on link 124, and lifts the entire bench assembly upwardly and rearwardly in the direction of the arrow in FIG. 16. As the bench lifts up, the four bar linkage will pull the support foot 118 inwardly to fold up against the support tube 100. The assembly pivots through an angle of more than 80°, past the vertically upright position, so that it is inclined slightly rearwardly in the storage position of FIG. 17. Because it is tilted rearwardly, and the majority of the weight of the bench and the center of gravity are to the rear, it will not tend to fall back forwardly towards the horizontal position unless positively pulled away from the storage position. At the same time, the four bar linkage locks the bench assembly against tilting any further to the rear, and the solid, stable support base or frame will resist tipping over. Thus, no separate locking device is needed to lock the assembly in the storage position, unlike prior art arrangements. It can be seen that the bench assembly takes up very little floor space when in the storage position.

The bench apparatus 10 may optionally include a vertical dumbbell rack 140 secured to the rear end of the stationary frame in place of cross bar 96, as illustrated in FIG. 17. This provides convenient, compact storage for free weights or dumbbells, while adding to stability and resistance against tipping when the bench is in the upright storage position. The stored bench cannot be rotated back into an exercise ready position without first pulling the support foot outwardly and upwardly, as in the previous embodiment. The bench can then be rotated downwardly about pivot 105 back into the deployed, exercise ready position of FIG. 14.

Figure 18:
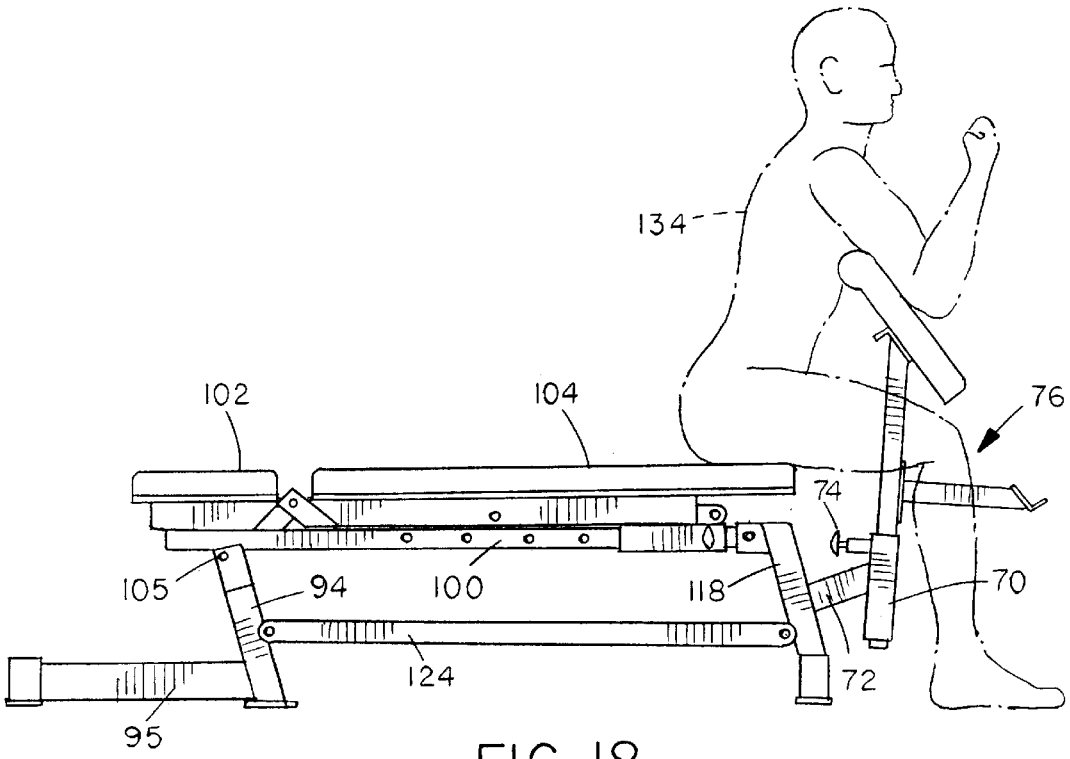
FIG. 18 is a side view similar to FIG. 14 with an attached preacher curl accessory, and showing a user in position.
Figure 19:
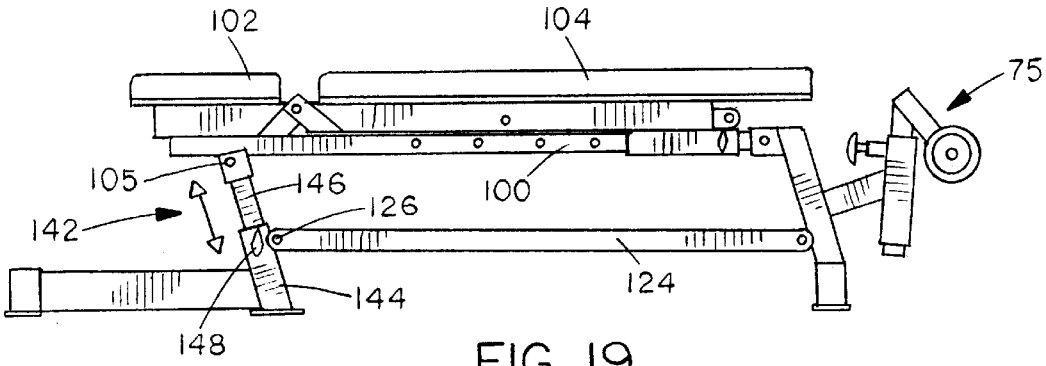
FIG. 19 is a side view similar to FIG. 14, with an additional adjustment for the bench, and with a different accessory attached to the bench support foot.
Figure 20:
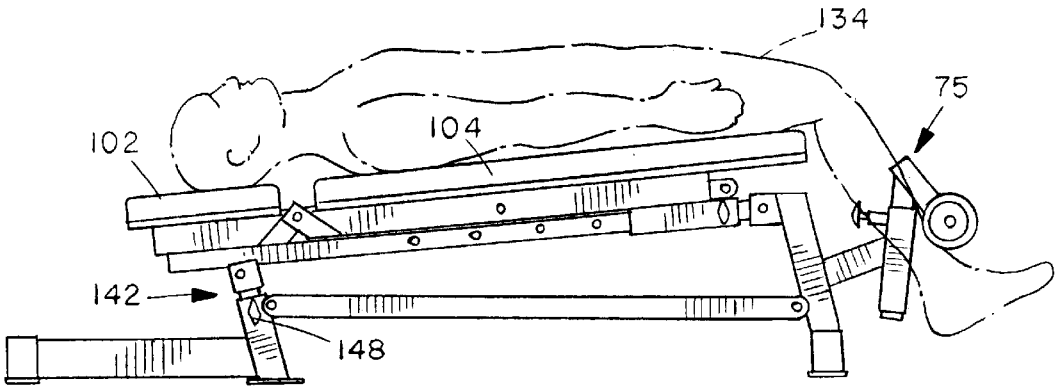
FIG. 20 shows the unit of FIG. 19 with the bench declined and with a user in position.

As in the previous embodiment, an attachment tube 70 may be attached to the support foot 118 for securing selected accessories to the foot, as illustrated in FIGS. 18 to 20, and like reference numerals have been used for like parts of the attachment as appropriate. Also as in the previous embodiment, the attachment tube 70 is oriented relative to foot 118 so that it will extend vertically in both the deployed and storage positions of foot 118. FIG. 18 illustrates a preacher curl attachment 76 secured in tube 70, with a user 134 seated on pad 104 with their arm resting on attachment 76 to perform preacher curl exercises. FIGS. 19 and 20 illustrate optional attachment and use of adjustable leg rollers 75.

FIGS. 19 and 20 also illustrate another optional modification, in which fixed upright strut 94 of FIGS. 13 to 18 is replaced with adjustable strut 142 which may be adjusted in height to adjust the height of the rear end of the bench. Adjustable strut 142 has a base tube 144 and an upper rod 146 telescopically mounted in tube 144. The bench support tube 100 is pivotally secured to the upper end of rod 146 via pivot 105. A pop pin 148 extending through an opening in tube 144 and any one of a series of aligned openings in rod 146 locks the rod at any desired extension out of tube 144. FIG. 20 illustrates the adjustable strut 142 in its lowermost position, which orients the bench in a decline press position for use by an exerciser reclining on the bench with their head on pad 102. By extending the strut 142 as in FIG. 19, the bench can be positioned in a flat, horizontal orientation for flat press exercises.

FIGS. 21 to 27 illustrate a modified exercise bench apparatus 200 according to another embodiment of the invention. This embodiment is similar to that of FIGS. 13 to 18, but has an improved pivotal linkage and a modified support frame with wheels or rollers 202 for transporting the bench when folded, as will be described in more detail below.

As in the previous embodiments, the apparatus 200 basically comprises an exercise bench pad assembly 204 pivoted to a support frame 206 by means of a four bar pivot linkage. The support frame 206 includes a rear, generally upright strut 208, a base support strut 210 extending horizontally rearwardly away from strut 208 at the ground level, and a cross bar 212 extending across the rear end of base strut 210 with rollers 202 mounted at each of its ends. As illustrated in FIG. 22, the rollers 202 will not engage the floor when the bench is in the deployed, operative position of FIGS. 21 and 22.

The four bar linkage basically comprises a primary connecting link 214 and a secondary connecting link 215 forming a pivotal linkage between the frame and a support foot 216 for the bench, with the bench 204 being mounted on the upper or primary connecting link as in the previous embodiments. The primary connecting link 214 is pivotally secured to the upper end of the upright strut 208 by a rear pivot 218, and pivotally secured to the upper end of the front support foot 216 for the bench by a front pivot 220. The secondary connecting link 215 is pivotally secured to the rear upright strut 208 via rear pivot 222, and to the support foot 216 by a front pivot 224 secured to the end of a spacer member 223, such that the pivot 224 is spaced rearwardly from the support foot. By comparison of the pivot linkage as illustrated in FIG. 22 with those of the previous embodiments as illustrated in FIGS. 3 and 18, it can be seen that the front pivot 224 of the secondary connecting link is secured at a lower point on the support foot than in the previous embodiments.

As in the previous embodiments, various exercise devices or other attachments may be selectively secured to the support foot 216. A downwardly angled bar or handle 225 projects forwardly from foot 216, and may be used as a handle when the bench is transported. The bench pad assembly 204 is similar to that of FIGS. 13 to 18, and comprises separate back and seat pads 226, 228, respectively, which are each secured at their inner, adjacent ends to a movable carriage 230 slidably mounted on the primary connecting link 214. Additionally, the back pad 226 is pivotally secured to the rear end of the primary connecting link 214 by means of elongate pivot link 232 which is pivoted to the connecting link 214 at pivot 234 and to the back pad 226 at pivot 235. The forward or inner end of the back pad 226 is pivotally mounted on bracket 236 via pivot 238, and the inner end of seat pad 228 is also pivotally mounted on the bracket 236. Bracket 236 is secured to the movable carriage 230. A pull-pin 240 extends through an opening in carriage 230 and a selected one of a series of spaced holes 242 in connecting link 214 in order to secure the bench pad assembly 204 at a selected position.

Figure 24:
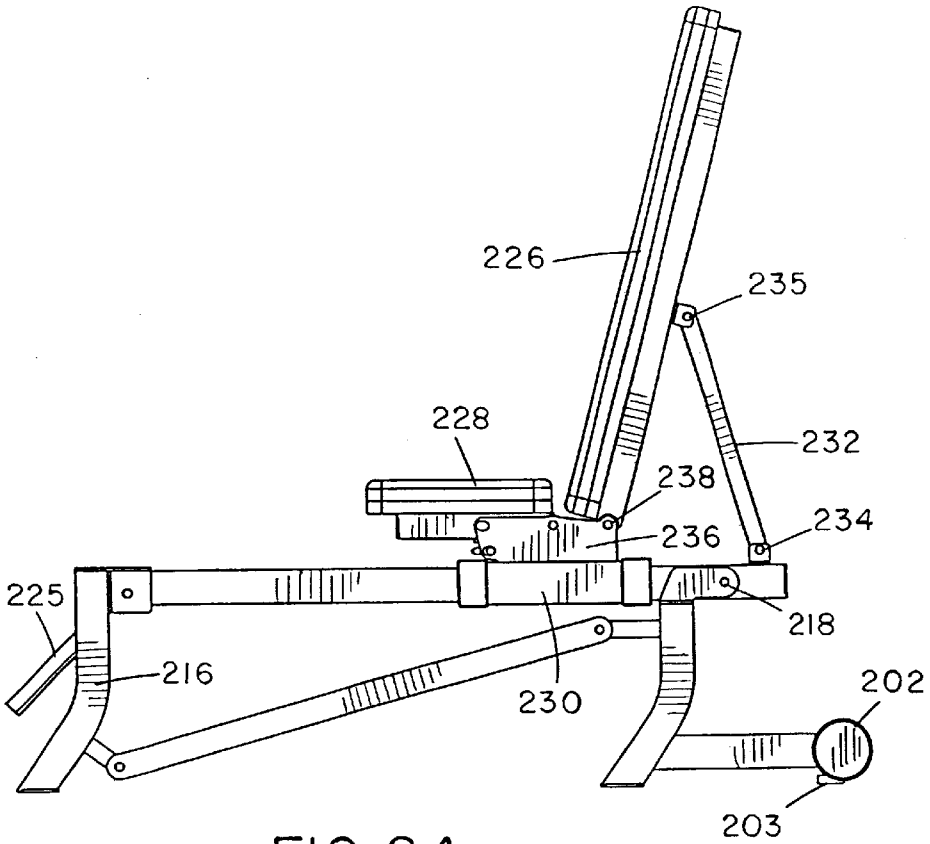
FIG. 24 is a side view similar to FIGS. 22 and 23 illustrating the back rest fully raised.

FIGS. 21 and 22 illustrate the bench pad assembly 204 in a generally flat, horizontal orientation with the back pad 226 aligned with the seat pad 228 for supporting a user lying prone horizontally along the pads, for performing certain exercises. FIG. 23 illustrates the assembly 204 in an intermediate position in which back pad 226 is inclined upwardly. In order to move the assembly to this position, a user simply pulls the pull-pin 240 outwardly to release the carriage, and slides the bench pad assembly and carriage 230 rearwardly along linkage 214 towards the rear upright strut 208. This will cause the back pad 226 to pivot upwardly about the fixed pivot 234 and pivot link 232. When the desired back pad orientation is reached, the pull-pin is released to extend through a new aligned hole 242 in the linkage 214, securing the pad assembly in position. FIG. 24 illustrates another possible back pad orientation in which the carriage 230 is adjacent the rear upright strut and the back pad 226 is more or less upright.

Figure 25:
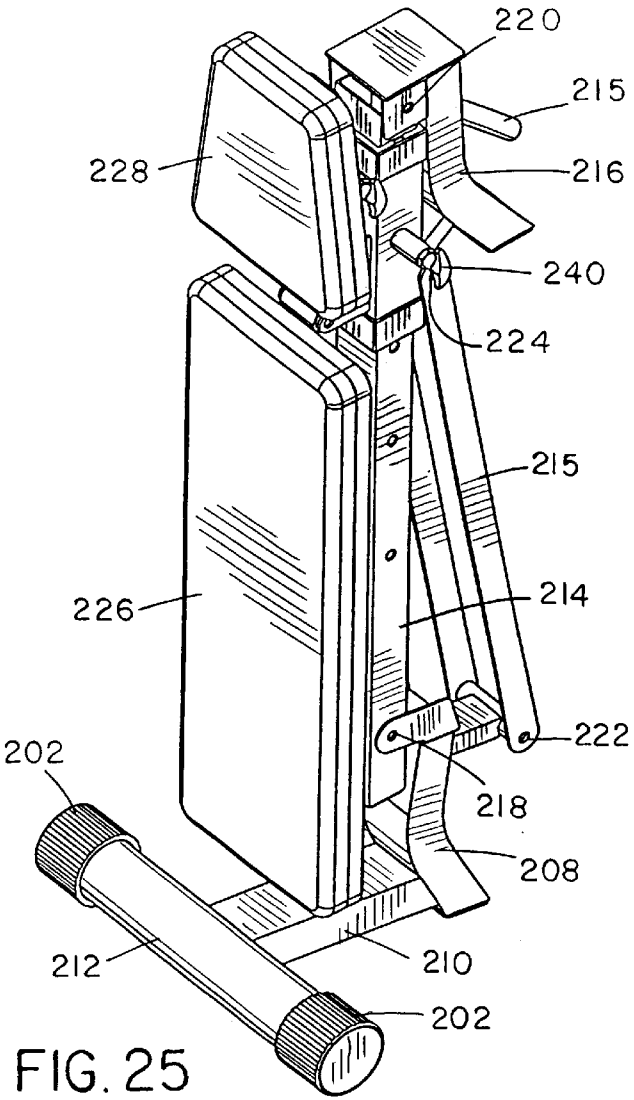
FIG. 25 is a perspective view of the bench of FIGS. 21 to 24 in a folded, storage position.
Figure 26:
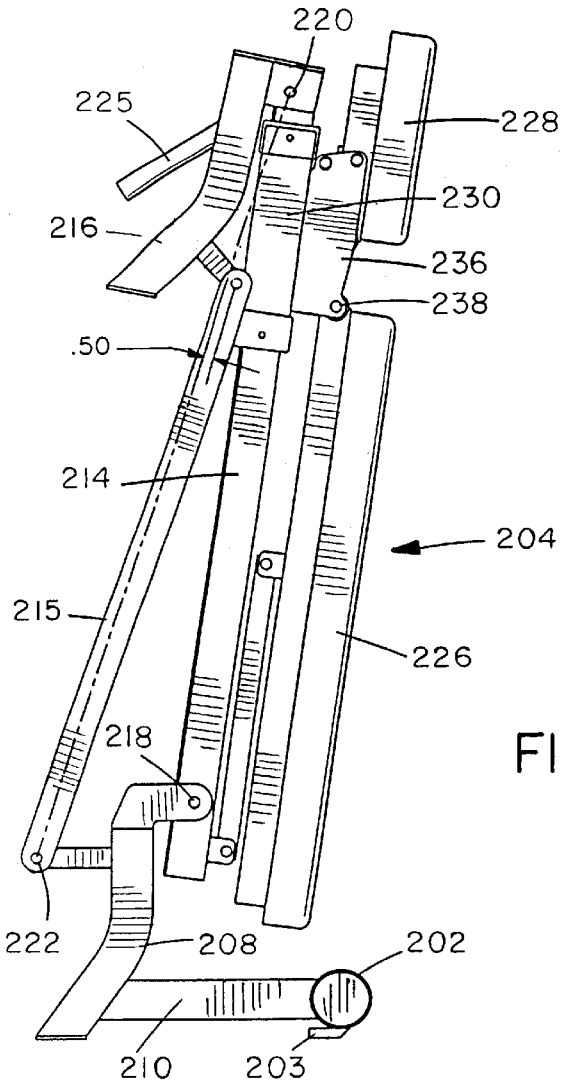
FIG. 26 is a side view of the bench in the folded position of FIG. 25.

As noted above, the main difference between this embodiment and the previous embodiments is the position of the pivot points 218, 220, 222, and 224 of the four-bar linkage connecting the support foot to the frame. FIGS. 25 and 26 illustrate the relationship between the four-bar linkage pivot points when the bench is in the folded, storage position. In FIG. 26, the front pivot 220 of the primary link is labeled A, the rear pivot 218 is labeled B, the front pivot 224 of the secondary connecting link is labeled C, and the rear pivot 222 is labeled D. As seen in this drawing, the front pivot point C of the secondary connecting link has bisected the imaginary line or plane connecting the front pivot point A of the primary connecting link and the rear pivot point D of the secondary connecting link, shown in dotted line in FIG. 26. In fact, the pivot point C rests about ½ inch behind this line. This firmly locks the front support foot 216 in place, preventing it from unlocking unless it is lifted by the handle 225 mounted on its front face in an upward and outward direction, thus unfolding the bench. This keeps the bench secure in the folded position. Although the spacing of pivot point C is 0.5 inches behind the line A-D in the illustrated embodiment, the spacing may be more than 0.5" or less than 0.5" in other embodiments, or point C may be substantially in-line with pivot A and D. However, the larger the spacing, the more securely the bench will be locked in the storage position.

The four-bar linkage pivot position arrangement of FIGS. 21 to 27 is more stable and secure than that of the previous embodiments. It can be seen by a comparison of FIG. 26 with the equivalent storage position of the first embodiment of the bench, as illustrated in FIG. 12, where the corresponding pivot points have been labeled A, B, C and D as in FIG. 26, that the front pivot C of the secondary connecting link 32 of FIG. 12 never intersects the line joining the front pivot point A of the primary connecting link 30 to the rear pivot point D of the secondary connecting link. Although the front support foot 36 is locked in the illustrated position in FIG. 12, it is not as secure as the foot 216 in the folded position of FIG. 26. In contrast, in the embodiment of FIGS. 21 to 27, due to the relationship between the linkage pivot points, the front pivot of the secondary connecting link intersects the line joining pivot points A and D when the bench is folded into the storage position, improving the locking ability of the support foot and providing a safer and more secure vertical storage position. Since the support foot in FIG. 26 must be lifted upwardly and outwardly about its pivot connection A to the primary link in order to unlock and unfold the bench, there is less risk of the bench accidentally unfolding when bumped. Additionally, the bench can be tipped or tilted without unfolding.

Figure 27:
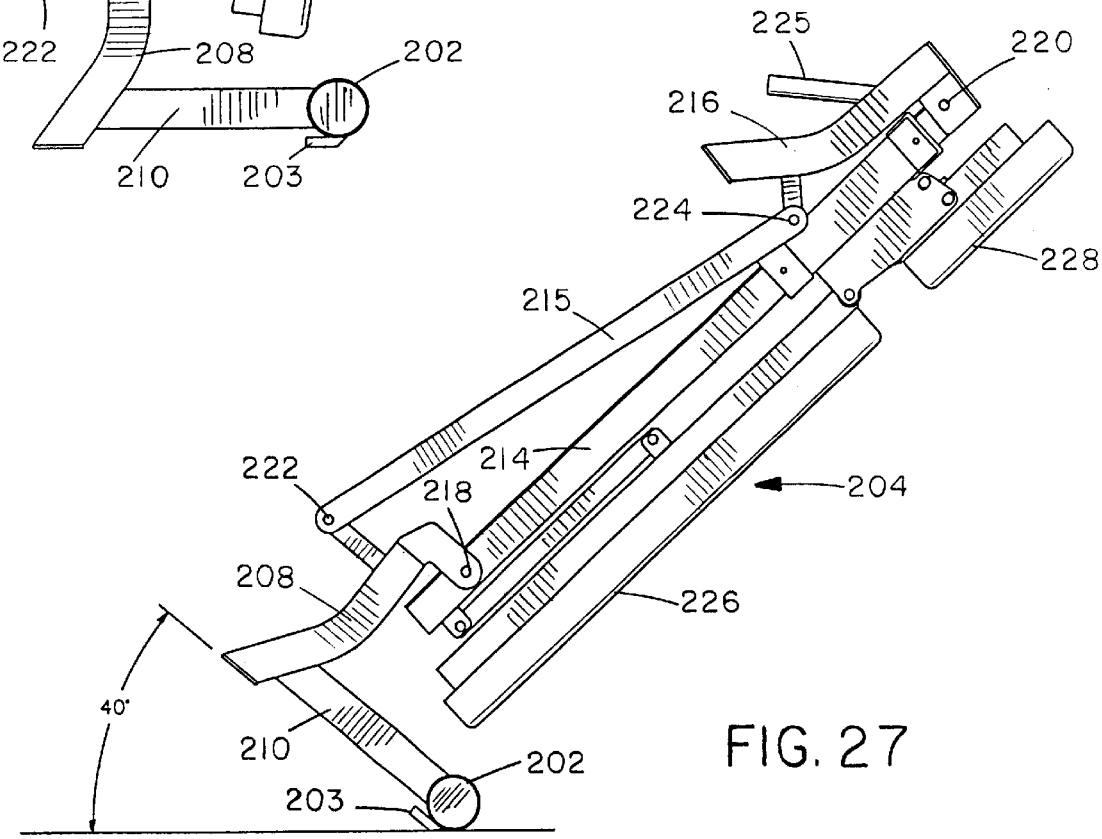
FIG. 27 is a side view of the bench in a folded, storage condition and tilted rearward in a transport position for moving the bench.

Because of the improved locking feature in this embodiment which allows the bench to be tilted without unlocking, the wheels 202 can be added to the support frame as indicated in order to allow the bench to be transported when in the locked storage position, as indicated in FIG. 27, without fear of the support foot unlocking. As illustrated in FIG. 27, the bench is tilted rearward from the vertical storage position of FIG. 26 until the wheels 202 are in operative engagement with the ground, and can then be readily moved to a new position as needed, without requiring any secondary locking devices such as through pins, pull-pins, or tension knobs to hold the bench in the folded position during transport. The positioning of the four-bar linkage pivot points prevents the bench from unfolding when tilted. Once the desired new position is reached, the bench is returned to the upright position, and handle 225 is gripped and moved upwardly and outwardly in order to unfold the bench, and the bench is then returned to the operative position of FIGS. 21 and 22. The wheels 202 are mounted at the end of the rear support base 210 in such a manner that they will not engage the floor unless the bench is tilted, so that the bench cannot accidentally roll or move on the user when in the exercise ready or deployed position. A brake or stop member 203 may be provided to prevent the wheels from touching the ground when the bench is deployed, or in the upright storage position.

Figure 28:
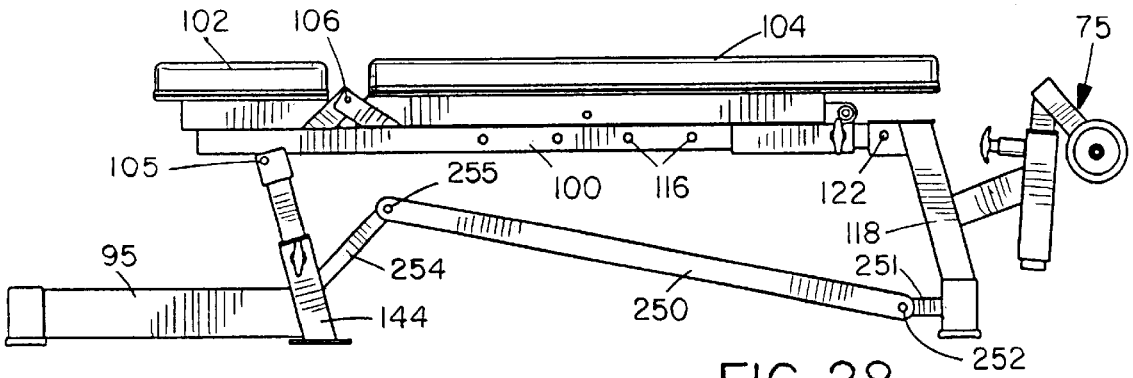
FIG. 28 is a side elevational view of another modified foldable bench in a horizontal, deployed position.
Figure 30:
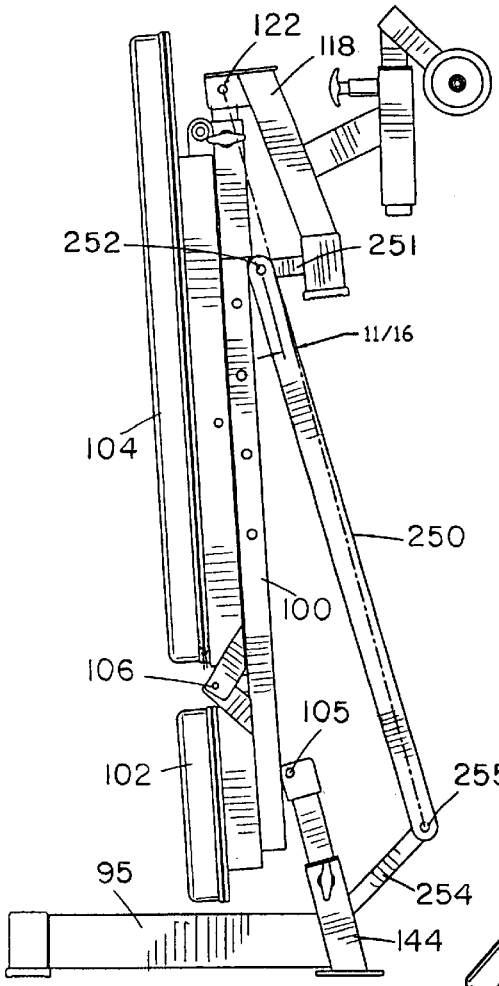
FIG. 30 illustrates the bench of FIGS. 28 and 29 in the fully folded storage position.
Figure 29:
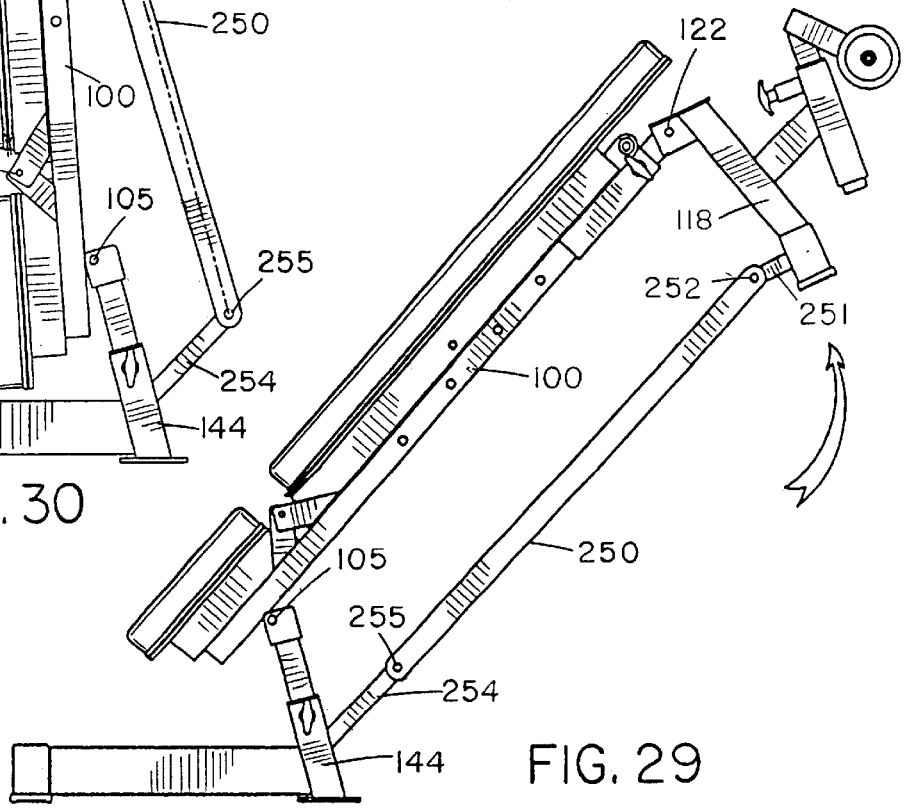
FIG. 29 is a side elevational view of the bench of FIG. 28 being folded towards a storage position.

FIGS. 28 to 30 illustrate a modification of the foldable bench of FIGS. 13 to 20 but with a modified four-bar linkage in which the pivot points have been moved in order to provide the improved locking capability of the embodiment of FIGS. 21 to 27. The embodiment of FIGS. 28 to 30 is otherwise identical to that of FIGS. 13 to 20 and like reference numerals have been used for like parts as appropriate. The primary connecting link 100 of the four-bar linkage is identical to that of FIGS. 13 to 20, with the same front pivot point 122 (A) and rear pivot point 105 (B) position as in the first embodiment. However, the secondary connecting link 124 and pivots 126 and 128 have been changed. As illustrated in FIGS. 28 to 30, a secondary connecting link 250 is pivotally secured adjacent the lower end of the support foot 118 via front pivot 252 (C) on spacer 251. A fixed, upwardly angled mounting bar 254 projects forwardly from rear upright strut 144 of the frame, and the rear end of connecting link 250 is pivotally secured to the end of bar 254 via rear pivot 255 (D). Thus, as compared to the secondary connecting link 32 and pivots illustrated in FIG. 14, this embodiment has a front pivot 252 which is lower on the support foot than pivot 128, and a rear pivot 255 which is moved forwardly and upwardly relative to the rear pivot 128 of the embodiment of FIGS. 13 to 20.

FIGS. 28 to 30 illustrate the sequence of folding the bench from the exercise-ready position of FIG. 28 into the folded, vertical storage position of FIG. 30. As indicated in FIG. 29, the user lifts the front end of the bench upwardly in the direction of the arrow, causing the four-bar linkage to pivot about the various pivot points as indicated. The motion is continued until the bench reaches the fully folded, storage position of FIG. 30. It can be seen that the front pivot C of the secondary connecting link 250 has intersected the dotted line connecting the front pivot A of the primary connecting link 100 and the rear pivot D of the secondary connecting link, due to the movement of the rear pivot D to the end of the angled mounting bar 254. Pivot C rests almost 0.75 inches behind the dotted line connecting pivots A and D when in the storage position. This makes the bench much more stable, secure, and therefore safer when in the storage position than in the embodiment of FIGS. 13 to 20.

It will be understood that the improved, more secure four-bar linkage may be used in place of the linkage of any of the embodiments of FIGS. 1 to 20. Attachments or exercise arms could be added to either end of the bench in any of the illustrated embodiments, and the stationary frame or base of the embodiments of FIGS. 13 to 30 may be equipped with exercise arms or uprights for holding a barbell. The exercise bench could be mounted on another piece of equipment such as a dumbbell rack, squat rack, or the like. The bench of any of the illustrated embodiments may also be used on a multi-station gym, if desired, as either a full-length bench as illustrated, or a smaller seat. Because of its ability to fold into a vertical storage position and save on floor space, the folding bench of this invention would enhance any number of existing exercise machines or exercise products.

Although the bench is formed in two separate parts in each of the above embodiments, it may be alternatively comprise a single pad for supporting the user. Referring to FIGS. 19 and 20, if a single pad on a single support replaced pads 102,104, the bench could be adjusted past horizontal and the user could perform decline (FIG. 20), flat (FIG. 19) and incline exercises while lying prone on the pad.

In each of the above embodiments, a foldable exercise bench with a pivotally attached support foot can be moved readily between the deployed or exercise-ready position simply by lifting up or lowering the bench with one hand, without having to release any locking pins or devices and subsequently re-insert locking pins after moving the bench to a new position. The support foot is automatically folded up flat against the bench by a four-bar linkage as the bench is lifted into the storage position, and the apparatus is automatically self-locking in each position. Because the bench is rotated rearwardly past the vertical position into the storage position, the weight distribution and center of gravity is such that the bench will stay in the storage position until positively moved out of that position by a user, without any need for additional locking devices. The exercise bench is designed for performing free weight exercises of various types, and can be readily folded up out of the way when not in use, so that it takes up very little floor space. The bench has multiple, easy to perform adjustments providing a plurality of different exercise positions for performing many different types of free weight exercises.

The bench can fold and unfold with very little effort. The support foot automatically folds in as the bench is folded, and the bench is self-locking in both the exercise ready and storage position without the use of locking pins. This is both safer and more convenient than previous systems requiring locking pins which could fall out, be misplaced, or, if used improperly, potentially result in injury.

Although some exemplary embodiments of the invention have been described above by way of example only, it will be understood by those skilled in the field that modifications may be made to the disclosed embodiment without departing from the scope of the invention, which is defined by the appended claims.

I claim:

1. A foldable exercise bench apparatus, comprising a stationary frame;

an exercise bench pivotally mounted on the frame for movement between a retracted, generally upright storage position and at least one deployed position for supporting a person during exercise, the bench having opposite first and second ends;

a support foot adjacent the first end of the bench having an upper end pivotally mounted relative to the bench for rotation between a first, storage position extending generally alongside the bench when the bench is in the upright, storage position, and a second, support position in which the support foot extends at an angle to the bench and engages the floor to support the bench in the deployed position;

a pivotal linkage between the support foot and frame for automatically pivoting the support foot from the second position to the first, storage position when the bench is moved into the upright, storage position;

the pivotal linkage comprising a four-bar linkage having a first connecting link and a second connecting link, a front pivot pivotally connecting the first connecting link to the support foot, a rear pivot pivotally connecting the first connecting link to the frame, and second front and rear pivots pivotally connecting the second connecting link to the support foot and the frame, respectively, at locations spaced below the first connecting link pivots;

the relationship between the front and rear pivots of the first and second connecting links being such that, when the bench is moved from the deployed position to the storage position, the front pivot of the second connecting link is moved to a predetermined location relative to a line connecting the front pivot of the first connecting link to the rear pivot of the second connecting link, whereby the bench and support foot are locked in the storage position and can be released only by first rotating the support foot upwardly about said first connecting link front pivot; and the bench and support foot each being freely movable from the deployed and second positions to the storage and first positions, respectively, by lifting the bench.

2. The apparatus as claimed in claim 1, wherein the position relationship between the front and rear pivots of the first and second connecting links is predetermined such that, when the bench is moved from the deployed to the storage position, the front pivot of the second connecting link intersects the line connecting the front pivot of the first connecting link and the rear pivot of the second connecting link.

3. The apparatus as claimed in claim 2, wherein the front pivot of the second connecting link in the storage position is located at a spacing behind the line connecting the front pivot of the first connecting link and the rear pivot of the second connecting link.

4. The apparatus as claimed in claim 1, wherein the second connecting link is spaced above a floor supporting the frame when the bench is in the deployed position.

5. The apparatus as claimed in claim 1, wherein the second connecting link is inclined upwardly between the front pivot and rear pivot.

6. The apparatus as claimed in claim 1, including a spacer member extending rearwardly from the support foot, the front pivot of the second connecting link being connected to said spacer member and spaced rearwardly from said support foot.

7. The apparatus as claimed in claim 1, including at least one wheel mounted on the frame for engaging the ground to allow the apparatus to be transported when the bench is in the storage position and the apparatus is tilted rearwardly from the upright position.

8. The apparatus as claimed in claim 7, wherein the frame includes an upright rear member having an upper end and a lower end, the pivotal linkage being connected between the support foot and upright rear member, and a base support member extending rearwardly from the lower end of the upright rear member, the base support member having a rear end and the wheel being rotatably mounted at the rear end of the base support member.

9. The apparatus as claimed in claim 7, wherein the support foot has a forwardly projecting handle for gripping by a user when transporting the apparatus on the wheel.

10. The apparatus as claimed in claim 7, wherein the wheel is positioned out of operative engagement with the ground when the apparatus is in the deployed position.

11. The apparatus as claimed in claim 1, wherein the bench is supported on top of said first connecting link, and comprises at least one pad for supporting a user.

12. The apparatus as claimed in claim 11, including a carriage slidably mounted on the first connecting link and movable into a plurality of different positions on the connecting link, the pad being pivotally linked to the carriage, whereby adjustment of the carriage position varies the orientation of the pad.

13. The apparatus as claimed in claim 1, wherein the bench is formed in two separate parts, comprising a back pad and a seat pad, and at least the back pad is pivotally mounted on the first, connecting link for movement between a plurality of different orientations relative to the seat pad.

14. The apparatus as claimed in claim 13, including a carriage slidably mounted on the first connecting link and movable into a plurality of different positions along the bar, and a locking device for releasably locking the carriage in a selected position on the connecting link, at least the back pad being pivotally linked to the carriage, whereby adjustment of the carriage position varies the orientation of the bench.

15. A foldable exercise bench apparatus, comprising:

a stationary frame;

an exercise bench pivotally mounted on the frame for movement between a generally upright storage position and at least one deployed position for supporting a person during exercise, the bench having opposite front and rear ends;

a support foot adjacent the front end of the bench having an upper end and a lower end for engaging the floor when the bench is in the deployed position;

a four-bar pivotal linkage pivotally securing the bench and support foot to the frame, the four-bar linkage having a first connecting link secured to the bench and a second connecting link, a first front pivot pivotally connecting the first connecting link to the support foot and a first rear pivot pivotally connecting the first connecting link to the frame, a second front pivot spaced below the first front pivot and pivotally connecting the second connecting link to the support foot, and a second rear pivot pivotally connecting the second connecting link to the frame;

the second front pivot being in a predetermined position relative to the first front pivot and second rear pivot whereby, when the bench is moved from the deployed position to the storage position, the second front pivot intersects an imaginary line connecting the first front pivot to the second rear pivot;

the pivotal linkage being arranged to pivot the support foot between a support position extending from the front end of the bench to the floor to support the front end of the bench and a storage position extending generally alongside the bench as the bench is moved from the deployed position to the upright, storage position; and the bench and support foot each being freely movable from the deployed and support positions to the storage positions by lifting the front end of the bench.

* * * * *